United States Patent [19]

Pruski

[11] Patent Number: 4,643,598

[45] Date of Patent: Feb. 17, 1987

[54] PRINT HEAD FOR WIRE MATRIX PRINTER

[75] Inventor: John A. Pruski, Schiller Park, Ill.

[73] Assignee: AT&T Teletype Corporation, Skokie, Ill.

[21] Appl. No.: 764,464

[22] Filed: Aug. 12, 1985

[51] Int. Cl.[4] ..... B41J 3/12

[52] U.S. Cl. ..... 400/124; 101/93.05

[58] Field of Search ..... 400/124; 101/93.05; 335/273

[56] References Cited

U.S. PATENT DOCUMENTS 4,209,260 6/1980 Jung ..... 400/124 X 4,230,412 10/1980 Hebert ..... 400/124

4,444,519 4/1984 Howell ..... 400/124 X

*Primary Examiner*—Paul T. Sewell

*Attorney, Agent, or Firm*—A. A. Tirva

[57] ABSTRACT

A wire matrix print head has a plurality of print wires each operatively connected to an armature and a core with a predetermined space formed between said armature and said core. The print ends of all wires are simultaneously aligned with the open end of the housing closest to the point of printing by a single operation. The alignment is in proportional relationship with the dimension of the space between an armature and a related core.

4 Claims, 5 Drawing Figures

FIG. 4
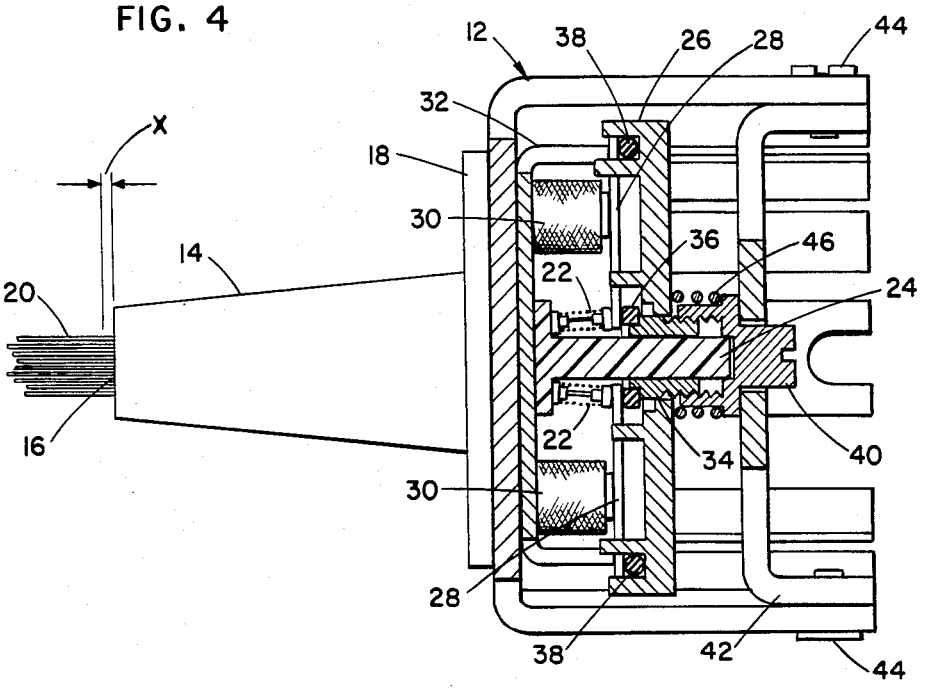
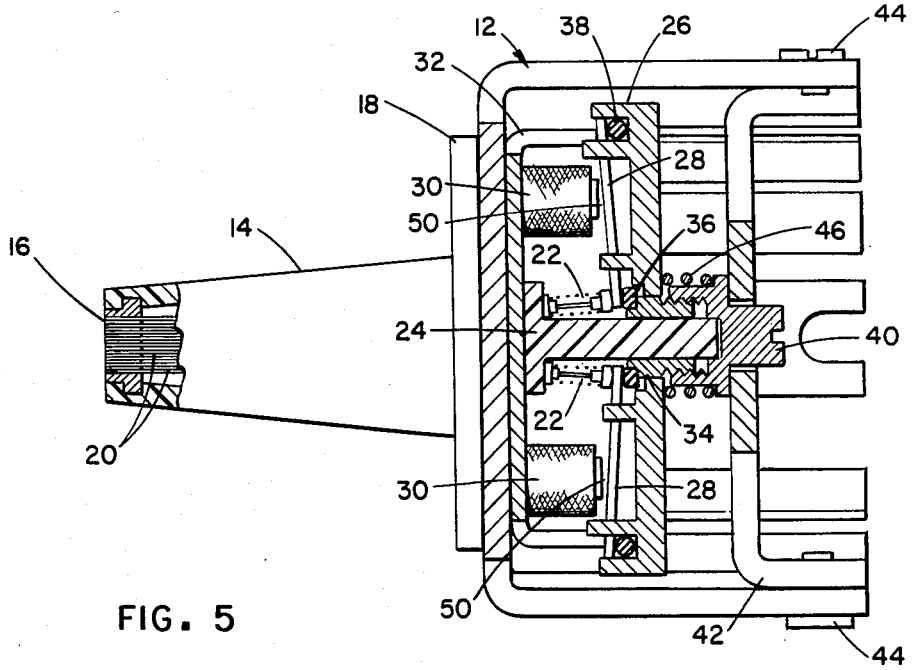
FIG. 5

PRINT HEAD FOR WIRE MATRIX PRINTER

DESCRIPTION

TECHNICAL FIELD

This invention relates to print heads used in wire matrix printers and, more particularly, to print heads having wire alignment features.

BACKGROUND ART

The wire matrix printers are provided with a plurality of print wires which are typically moved in a predetermined fashion by electromechanical devices into contact with the record media where, upon command, each selected wire may impact the media leaving an imprint thereon.

To achieve proper printing, the print wires must be machined and aligned so that their impact or print producing ends line up with an open end of the print head housing closest to the record media. If the wires are not properly aligned with each other, they will tend to produce unacceptable printing. Also, if the print ends of the wires extend beyond the open end of the housing when the wires are not energized, they may be subjected to unnecessary wear and tear when the print head is moved.

Because of the number of print wires used in an average print head, the alignemnt of wires becomes a tedious and time consuming undertaking. The wires may break or become worn out after an extended use and may require replacement on individual or group basis. The replacement print wires have to be aligned with other wires retained in the print head. Generally, the alignment of the print wires is controlled by a space or gap existing between an armature connected to one end of a specific wire and a core related to that same wire. Heretofore, as best seen in FIG. 3 of the drawings, each individual wire was adjusted separately thus consuming a substantial amount of time especially, if several wires had to be replaced.

DISCLOSURE OF THE INVENTION

In accordance with the present invention, means are provided to align all of the print wires in a print head at the same time, rather than aligning each individual wire.

Generally, a housing of a matrix print head formed with annular and elongated portions has print wires extending through the elongated portion so that the wires, when energized for printing, extend out of the open end of the housing. The annular portion of the housing contains a core and an armature for each of the print wires. The armatures are retained by a backplate mounted on a spindle. A movable sleeve extends through the backplate and, as the sleeve is moved by operation of a rotatable nut, forces the armatures for all wires to move toward their respective cores forming identical gaps therebetween. The print ends of the wires are moved out of the open end of the housing as far as possible and machined to length at a given distance from the edge of the open end, said distance corresponding to the gap between the armatures and selected cores. When, after machining, the wires are retracted into the housing, they align flush or slightly underflush with the edge of the open end of the elongated portion of the housing. The present invention allows replacement and subsequent alignment of all wires in the print head at the same time, and overcomes the disadvantages known in the existing art.

THE DRAWINGS

FIG. 4 is a side elevational view, partially broken away, similar to FIG. 2, showing the print wires prior to alignment;

FIG. 5 is a side elevational view, partially broken away, showing print wires aligned in accordance with the present invention.

DETAILED DESCRIPTION

Figure 1:
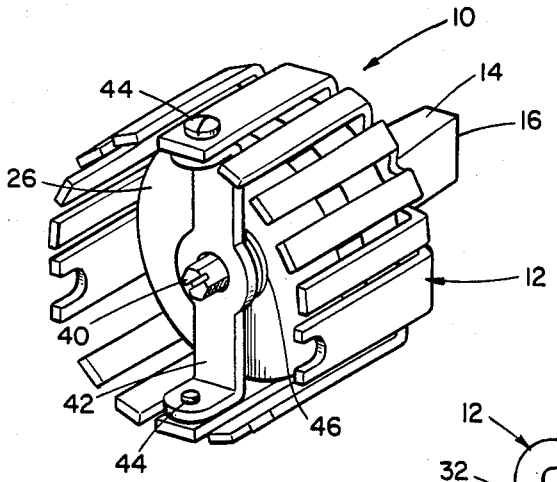
FIG. 1 is a perspective view of the print head.

Referring to FIG. 1, there is shown a print head, generally designated 10, having a housing consisting of an annular portion 12 and an elongated portion 14 which has an open end 16.

Figure 2:
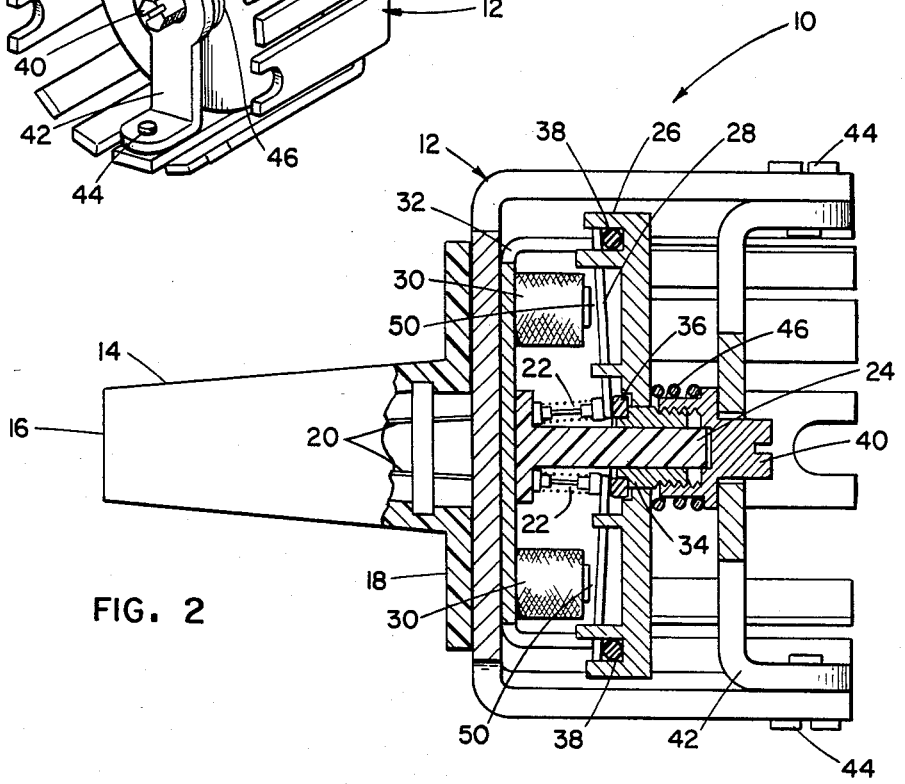
FIG. 2 is a side elevational view of the print head partially broken away to show the elements inside the annular portion of the housing.

As best seen in FIGS. 2, 4 and 5, the elongated portion 14 has a flange 18 which joins this portion to the annular portion 12 of the housing. A plurality of print wires 20 extend from the annular portion into the elongated portion. The print head 10 is positioned in the printer (not shown) with the open end 16 of the elongated housing portion facing paper or other record media which is to be impacted by the wires to produce printing. Thus the ends of the wires positioned at the open end of the housing constitutes the impact or printing ends of same. The opposite ends of the wires are mounted in the annular portion of the housing and are biased by springs 22 against other elements, as explained in greater detail later.

A spindle 24 is positioned substantially in the middle of the annular housing portion 12 and is secured to and in alignment with the elongated portion 14. Mounted about the spindle is a backplate 26 which retains armatures 28 for each of the print wires 20. Interposed between the armatures 28 and the wall of the annular housing portion, there are cores 30, positioned on a plate 32, the number of the cores corresponding to the number of print wires in the print head so that each one of the wires has a separate core and an armature.

Located on the spindle 24 is a movable sleeve 34 with a cushioning ring, or a backstop 36 interposed between the sleeve and the armature 28. Another cushioning ring 38 is interposed between the backplate 26 and the armature 28. The rings 36 and 38 are preferably made from resilient material so as to cushion the impact of a retracting armature against the backplate 26, provide insulation, and the like.

A nut 40, positioned in an end bracket 42 affixed to the housing by screws 44 or the like, is placed about the sleeve 34 and the spindle 24 to provide axial movement to the sleeve. A compression spring 46 is positioned between the flange of the nut 40 and the backplate 26.

In operation of this device, the backstop or resilient member 36 is made adjustable by movement of the sleeve 34 caused by rotation of the nut 40. The nut 40 is held captive by the bracket 42 and the compression springs 46. The sleeve 34 which extends through the backplate 26 is prevented from rotation by the backplate. As the nut 40 is turned, the sleeve 34 moves in a forward or rearward direction depending on the turning direction of the nut. The movement of the sleeve pushes the backstop member 36 against the armature 28 of each of the wires 20 and causes a change in the gap or space 50 between the respective armatures and cores 30. The wires 20 are spring biased by the springs 22 against their respective armatures 28 and move in conjunction with the movement of the armatures. This movement facilitates a line up of the printing ends of all wires 20 with the edge of the open end 16 of the elongated portion 14 of the housing.

FIG. 4 discloses the sleeve 34 after it has been moved to the left side limit causing the movement of the armatures 28 and, in turn, the movement of the print wires 20 so that the ends of the wires extend out of the open end 16 of the elongated housing portion 14. The gap 50 formed between the respective armatures 28 and cores 3 is proportionate to the distance X (approximately 2½ to 1), shown in FIG. 4, which represents the distance the wires extend outside of the open end of the elongated housing 14. The wires are machined to length at a distance X from the open end 16 while being held in the position illustrated in FIG. 4. After completion of the machining operation, with all wires extending out of the open end an equal distance, the nut 40 is rotated in the opposite direction causing the sleeve 34 to move to the right, in turn retracting the spring biased wires into the housing with the printing ends of all wires being in simultaneous alignment with the open end 16 of the elongated housing portion 14, as shown in FIG. 5.

Figure 3:
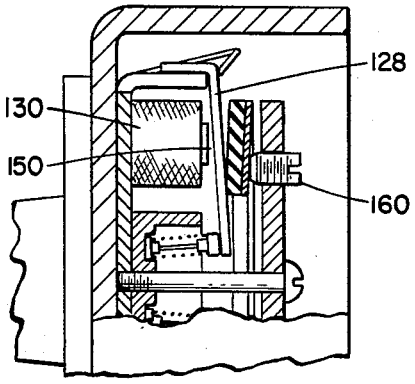
PRIOR ART FIG. 3
FIG. 3 is a partial side elevational view illustrating the print wire alignment features disclosed by prior art.

FIG. 3 illustrates the print wire alignment feature known in the art and generally used before the present invention. Here, the gap 150 between each armature 128 and each core 130 must be adjusted separately for each individual wire by rotation of an individual adjustment screw 160.

What is claimed is:

1. A matrix print head comprising:

(a) a housing formed with an annular portion and an elongated portion;

(b) a plurality of print wires extending from said annular portion through said elongated portion and being movable out of an open end of the latter;

(c) a plurality of cores positioned in said annular portion;

(d) a plurality of armatures positioned in said annular portion, each being operatively connected to one of a single print wire and being spaced from and movable relative to a related core;

(e) means for simultaneously adjusting the positions of other ends of all of the print wires relative to the open end of said elongated portion to insure that the dimension between the other ends of said wires and said open end is proportional to the dimension of the space between an armature and related core, said means comprising:

(i) a circular backplate supporting said armatures;

(ii) a movable sleeve mounted on a spindle, said sleeve extending through the center of said backplate and being adapted to operatively engage all of said armatures simultaneously and to move said armatures relative to related cores thereby forming a space of predetermined dimension between each armature and its related core;

(iii) means for moving said sleeve axially comprising a nut operatively connected to said sleeve, wherein said nut is supported by a bracket and a compression spring positioned between said backplate and said bracket.

2. Print head in accordance with claim 1, wherein a resilient member is interposed between said movable sleeve and said armatures.

3. Print head in accordance with claim 1, wherein said sleeve is prevented from rotation by said backplate.

4. Print head in accordance with claim 1, wherein said proportion between the dimensions of the other ends of wires and said open end and the dimension of the space between an armature and related core is substantially 2½:1.

* * * * *